United States Patent [19]

Forbes, Jr.

[11] 4,342,417

[45] Aug. 3, 1982

[54] END LOADED COMPARTMENTED CARTON

[75] Inventor: Hampton E. Forbes, Jr., Wilmington, Del.

[73] Assignee: Westvaco Corporation, New York, N.Y.

[21] Appl. No.: 178,937

[22] Filed: Aug. 18, 1980

[51] Int. Cl.[3] ..... B65D 5/48

[52] U.S. Cl. ..... 229/27; 229/15

[58] Field of Search ..... 229/37 R, 27, 15, 38, 229/39, 41 B, 41 R, 42; 206/45.14, 44

[56] References Cited

U.S. PATENT DOCUMENTS

| | | | |
|---|---|---|---|
| 2,825,496 | 3/1958 | Miessler | 229/37 R |
| 3,047,204 | 7/1962 | Wolawicz | 229/41 R |
| 3,326,444 | 6/1967 | Farquhar | 229/27 |
| 3,563,449 | 2/1971 | Farber . | |
| 3,680,687 | 8/1972 | D'Alenio | 229/27 |
| 3,682,297 | 8/1972 | Austin | 229/27 |
| 3,804,321 | 4/1974 | Farber . | |
| 3,845,898 | 11/1974 | Hackenberg | 229/41 B |
| 4,113,086 | 9/1978 | Farber . | |

*Primary Examiner*—Herbert F. Ross

[57] ABSTRACT

An end loaded compartmented carton is formed from a cut and scored blank of paperboard that is preglued and shipped to the user in a generally flat folded condition for loading. The carton when squared is of essentially rectangular configuration and contains a full length internal false wall located between two opposed carton side walls to form two compartments in the carton and a bridge panel for one of the compartments that is located between the false internal wall and an adjacent carton side wall. The compartment containing the bridge panel is formed without any double thick panels or other overlapped panels which could produce obstructions that might interfere with the easy loading of the carton.

2 Claims, 7 Drawing Figures

END LOADED COMPARTMENTED CARTON

BACKGROUND OF INVENTION

The present invention relates generally to end loaded folding paperboard cartons and more specifically to such cartons that include false internal walls which form internal compartments and provide protection for the packaged product. It is well known in the packaging industry to provide false walls in cartons where extra protection is needed. Moreover, false walls are commonly used in cartons for packaging small items in an effort to discourage pilferage. In addition, it is common in such cartons to provide bridge elements for supporting packaged items which are relatively smaller in size than the overall carton. Generally, such false walls and/or bridges are provided in the cartons as extensions of the glue flap used to secure the carton panels together. These extensions usually overlap all or most of the width of at least one of the carton side walls and further include one or more additional panels which are provided with glue flaps that are adhered to an opposite side wall of the carton. Thus, the panels extend between opposed walls of the carton and provide both a false wall effect and a support for the packaged product. Examples of such cartons are disclosed in applicant's prior U.S. Pat. Nos. 3,563,449; 3,804,321; and 4,113,086. However, cartons of this general type suffer from several shortcomings which relate essentially to problems encountered with the loading of the carton, the amount of paperboard used to fabricate the carton and the difficulty in manufacturing such cartons.

SUMMARY OF INVENTION

The carton of the present invention is formed from a single blank of paperboard or the like that is cut and scored to provide a substantially full length internal false wall which extends between two opposed side walls of the carton and an integral bridge member that extends between the internal false wall and an adjacent side wall of the carton. The construction is such that primary and secondary compartments are formed within the carton by the false wall with the bridge member being located within the primary compartment where the main product is loaded. The arrangement of parts produces a primary compartment that is unrestricted or unencumbered by glue flaps, extensions, or overlapping panels which would otherwise interfere with the smooth and efficient loading of the product. Moreover, the carton panels are arranged on the blank for convenient nesting of blanks which reduces waste, and the glue flaps and panels are located for straight line glue application which makes formation of the cartons possible on equipment that is readily available for increased manufacturing efficiency.

In its basic form, the carton is prepared from a blank comprising a plurality of outer carton side walls foldably attached together along parallel fold lines; a glue panel foldably attached to an edge of one of the side wall panels; a substantially full length interior false wall panel foldably attached to the opposite edge of the glue panel; a pair of glue flaps foldably attached to the opposite edge of the interior false wall panel; a bridge panel foldably attached to one of the glue flaps; and, another glue flap foldably attached to the bridge panel. When the carton is applied with glue and folded, the false interior wall and bridge panel together form an internal product supporting and locating structure which is smaller than the overall size of the outer carton. The internal structure consists of the internal false wall secured between two opposed outer side walls of the carton, and the bridge panel which is secured between the internal false wall and an adjacent outer side wall of the carton. In the case where a more rigid internal structure is required or desired, an optional auxiliary glue tab can be formed from the glue flap which joins the bridge panel with the internal false wall. The optional glue tab is designed to restrain the end of the interior false wall in the area of the location of the bridge panel.

After the carton is formed, it is folded flat for shipment to the user. When the carton is to be filled, it is squared to open the primary compartment before inserting the product. In accordance with the present invention, the primary compartment is completely unobstructed without any glued interior flaps or overlapped panels so that the product can be readily loaded without hangups or interference. Also, additional materials such as product instructions, warnings or coupons may also be inserted in the secondary compartment with relative ease.

DETAILED DESCRIPTION

The carton of the present invention is formed from a single flat blank of paperboard or the like that is cut and scored to provide at least four outer walls and an internal product supporting and locating structure that provides support and protection for the packaged product. The construction of the carton is characterized as having a primary product receiving compartment that is free from any internal obstructions that might hinder the easy loading of the carton.

Figure 1:
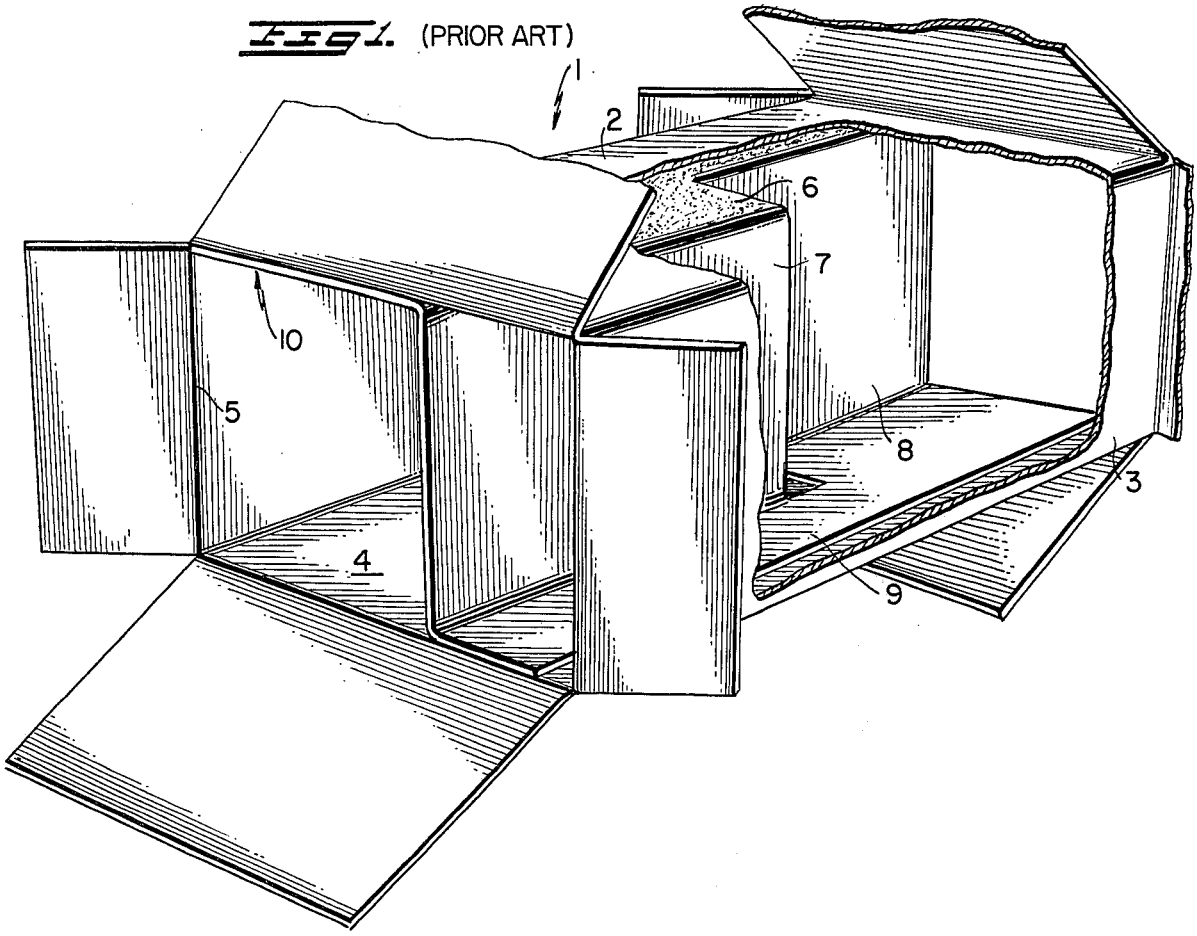
Fig. 1. (PRIOR ART)
FIG. 1 is a perspective view of a typical prior art carton with portions of the outer structure broken away to permit viewing of the inner structure.

FIG. 1 shows in some detail a view of a prior art style carton including an internal product supporting structure that has been used in the past. The carton 1 of FIG. 1 includes a top wall 2 and a front wall 3 that have been partially broken away to show the internal support structure. The carton also has a bottom wall 4, rear wall 5 and an integral glue panel 6 to which the top panel 2 is adhered. For the purpose of limiting any translational movement of the packaged product, the glue panel 6 has attached thereto a pair of staggered bridge panels 7,8 and a lower glue flap 9 that is adhered to the bottom wall 4. The panel 7 serves as a false wall in the carton and the panel 8 serves to stop or position a product that is smaller than the carton within the carton. Such cartons have generally served their intended purpose well except for loading problems that are encountered on high speed loading equipment. Numeral 10 illustrates the end of the glue panel 6 that extends inside the primary outer wall of the carton and which causes many of the loading difficulties. For instance, when light weight products that are substantially equal in size to the loading compartment and/or secondary inserts are to be packaged, the portion of the glue panel 6 shown at 10 tends to obstruct the loading area causing jam ups and other feeding problems. Accordingly, the carton of the present invention was designed to overcome this loading problem while still retaining the desirable supporting and protection features of the prior art cartons.

Figure 2:
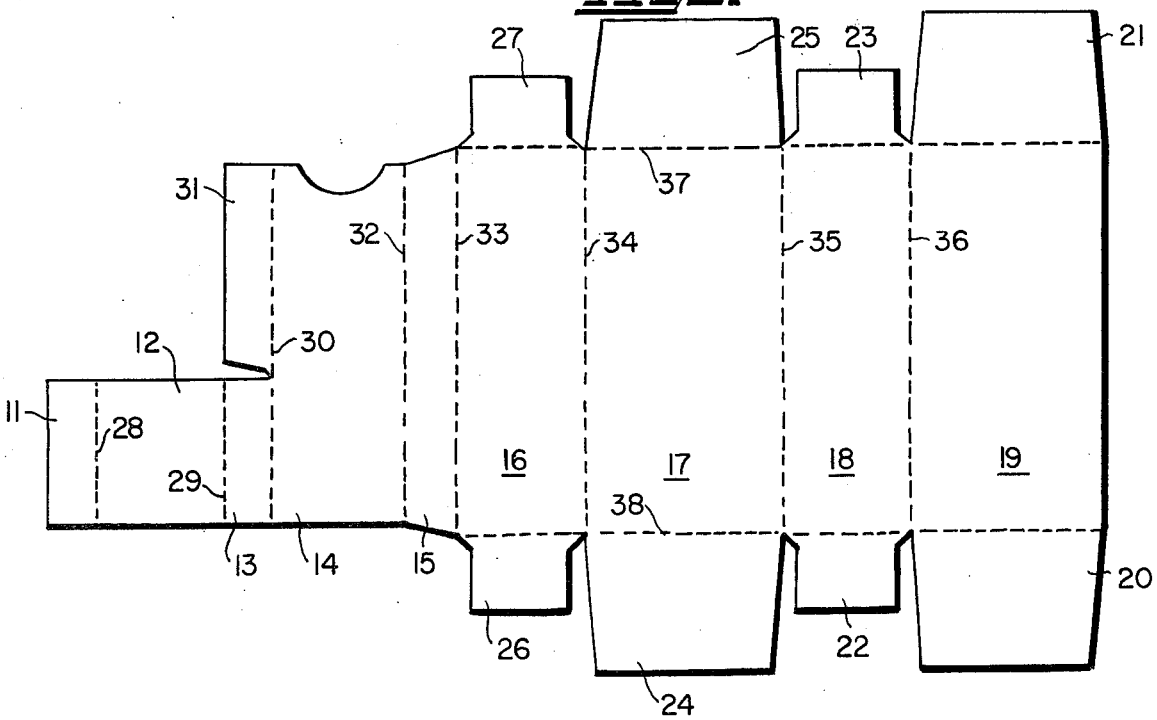
FIG. 2 is a plan view of a carton blank according to the present invention.

FIG. 2 illustrates a typical blank structure for the carton of the present invention. The primary outer walls of the carton are formed by the side walls 16,17,18 and 19 which are separated from one another by parallel score lines 34,35,36. Each of these side walls also include end closure flaps 20–27 foldably attached to the ends thereof along score lines 37,38 and the side wall 16 includes a glue panel 15 foldably attached to one edge thereof along score line 33. Meanwhile, the remaining panels of the blank make up the unique product supporting internal structure of the carton. For this purpose, an interior false wall 14 is foldably attached to the glue panel 15 along a score line 32, while a pair of glue flaps 13,31 are foldably attached to the opposite side of false wall 14 along a fold line 30, and the blank is completed with the addition of a bridge panel 12 attached to glue flap 13 along fold line 29, and a final glue flap 11 foldably attached to the opposite edge of bridge panel 12 along a fold line 28.

Figure 4:
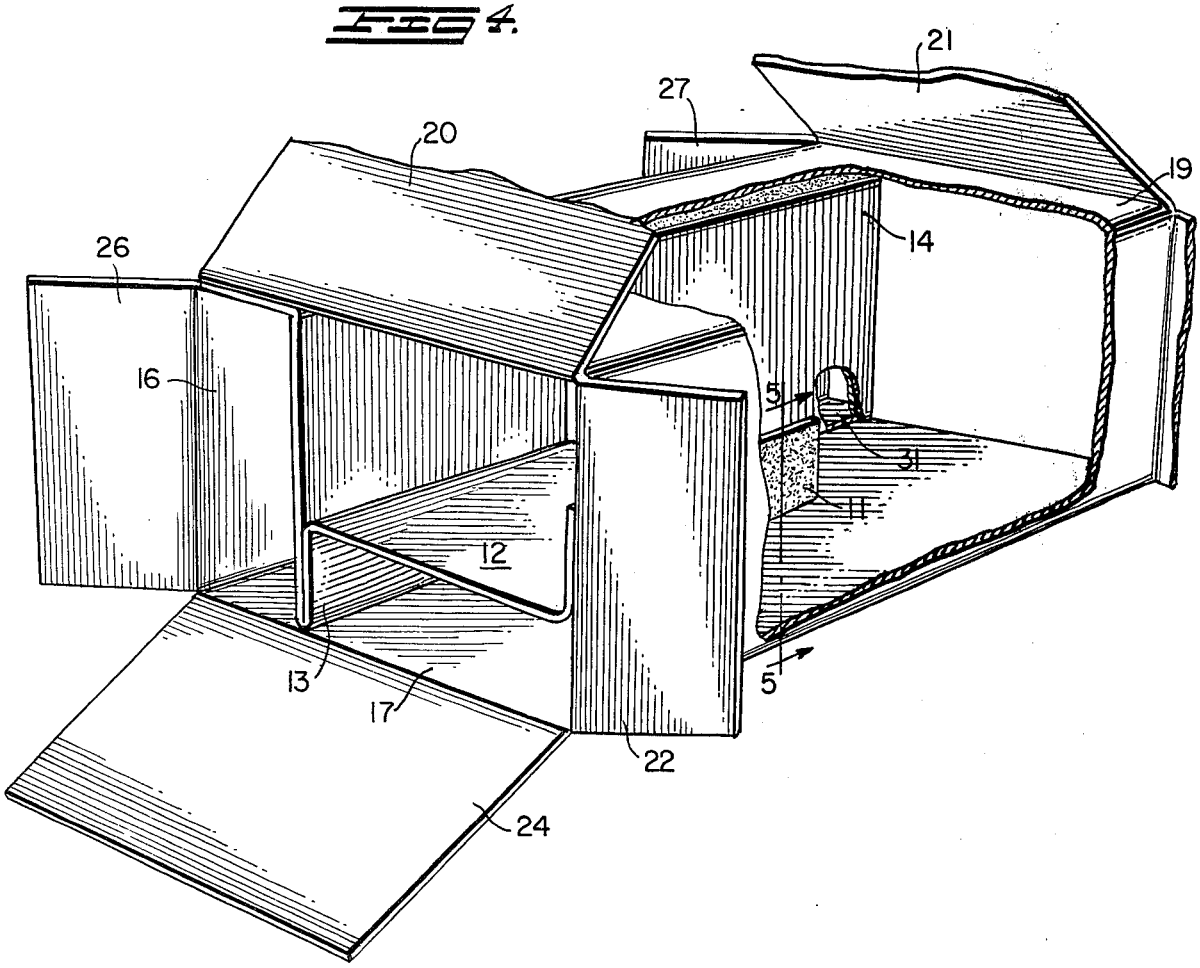
FIG. 4 is a perspective view of the carton prepared from the blank of FIG. 2 with portions broken away to show the inner structure.
Figure 5:
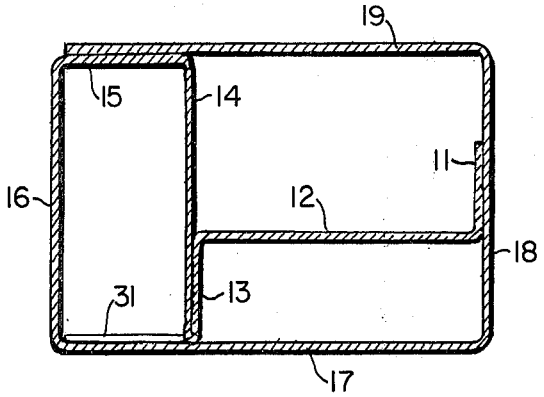
FIG. 5 is a typical cross sectional view of a carton prepared from the blank of FIG. 2.
Figure 6:
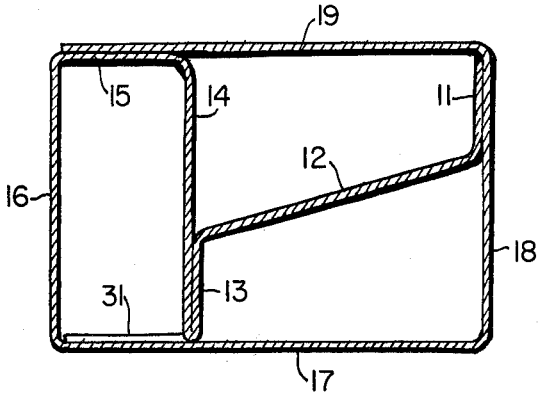
FIG. 6 is a typical cross sectional view of a modified carton construction; and, FIG. 7 is a perspective view of a carton prepared from the modified blank shown in FIG. 3.

When the blank is folded and glued as shown in FIG. 4, the glue panel 15 is adhered to the inside of top wall 19 to complete the basic outer structure and glue flap 31 is adhered to bottom wall 17 to orient and fix the false wall 14 in its proper position between the walls 17 and 19. Glue flap 13 is folded 180 degrees and adhered to the inside surface of false wall 14 and the bridge panel 12 is arranged to extend perpendicularly to false wall 14 and it is preferably fixed in position by adhering the final glue flap 11 to the adjacent front wall 18. The blank is folded according to the following steps. With the inside surface of the blank facing upwardly as shown in FIG. 2, adhesive is applied to the outer surfaces of glue flaps 13 and 31 and also to the outer surface of glue panel 15 from a bottom glue pot. The blank is then folded along score line 32 to position the various panels for gluing. The second fold takes place along score line 30 where the glue flap 13 is reversely folded and adhered to the outer surface of interior panel 14. A second adhesive application takes place from a top glue pot when adhesive is applied to the inside surface of glue flap 11. The third fold is along score line 34 to adhere the outer surface of glue flap 31 to bottom wall 17 and the inside surface of glue flap 11 to front wall 18. Finally the carton is completed by folding the top wall 19 over about score line 36 to adhere the outside surface of glue panel 15 to the top wall 19. In this manner, a reinforced compartmented carton is formed that has an unobstructed primary product compartment defined by the walls 14,17,18 and 19 that can readily be loaded with a product smaller than the carton itself or with a combination product and insert if desired. FIG. 5 shows the orientation and location of the various panels when the carton is squared for use. In this regard, note that the bridge panel 12 is arranged and positioned to support the bottom of the packaged product while the internal wall 14 positions the packaged product at one side of the carton. If desired, however, the bridge panel 12 may be arranged to be free floating or unattached to the side wall 18. FIG. 6 illustrates a typical orientation of the bridge panel 12 for such a modification. The dimensions of the bridge panel 12 for this arrangement depends upon the overall dimensions of the carton so that upon squaring the carton prior to loading, the bridge panel 12 assumes a position across the primary compartment to support the product. Meanwhile, the space provided in the package on the opposite side of the interior false wall 14 provides a secondary compartment wherein a second product or a paper insert may be included.

Figure 3:
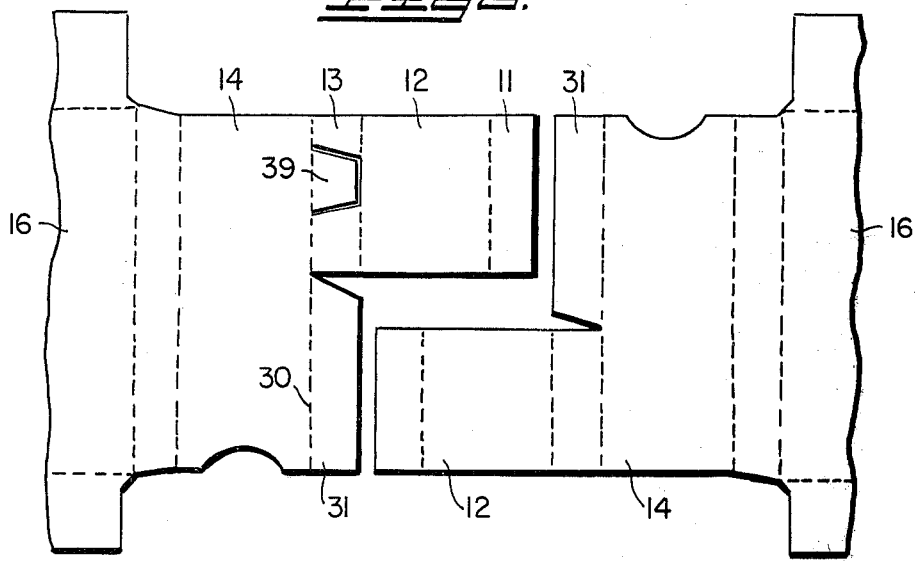
FIG. 3 is a plan view of a portion of the carton blank shown in FIG. 2 and a modified carton blank in nested condition.
Figure 7:
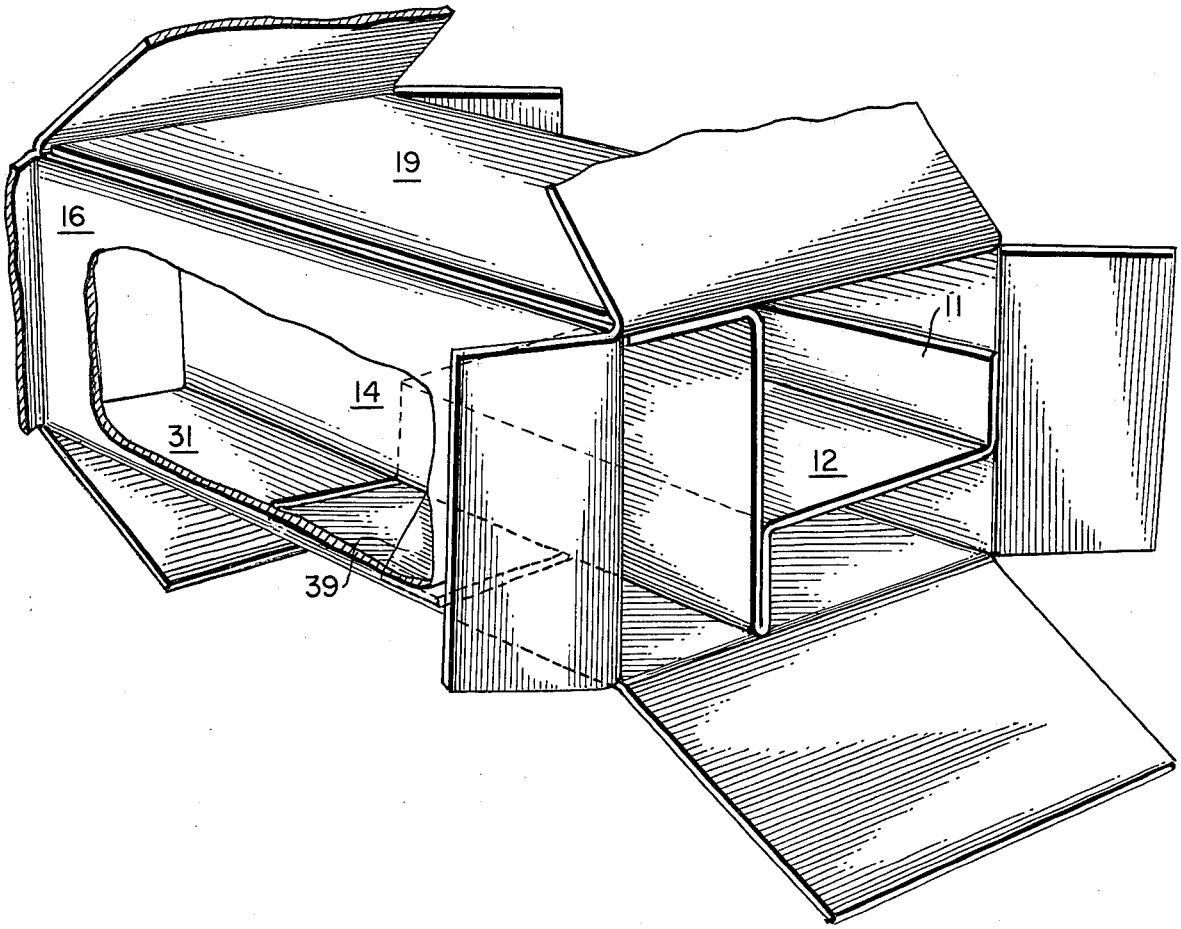

Accordingly, it may be seen that the present invention provides a reinforced compartmented carton that has considerable utility in the packaging of one or more products. The design and arrangement of the various panels provides at least one unobstructed compartment with a bridge support and a second compartment that may be used for other items. The preferred form of the carton has an internal false wall 14 that is held in place between opposed carton walls 19,17 primarily by the glue flap 37 that is adhered to the wall 17. However, where additional rigidity and strength is required, the end of the false wall 14 wherein the bridge panel 12 is attached can also be retained in place between the opposed walls 17,19. For this purpose, the blank shown in FIG. 3 is provided with an auxiliary glue tab 39 that is cut from the glue panel 13 attached to bridge panel 12. Thus, when the carton blank of FIG. 3 is folded and glued, the auxiliary glue tab 39 is applied with adhesive and reversely folded to become adhered to the bottom wall 17. FIG. 7 shows this arrangement wherein both the auxiliary tab 39 and the glue flap 31 are adhered to the bottom wall 17. Meanwhile, as in the preferred embodiment, the bridge panel 12 is arranged in position between the false wall 14 and an adjacent wall 18 of the carton.

This specification and the accompanying drawing describe and illustrate an improvement in end loaded compartmented cartons. It is to be understood, however, that modifications may be made in the embodiments shown within the knowledge of one skilled in the art, without deviating from the scope of the invention as defined in the appended claims.

I claim:

1. An end loaded compartmented carton formed from a single blank of paperboard or the like comprising:

(a) four elongated exterior side walls foldably attached to one another along their elongated side edges which are shiftable between a substantially flat collapsed condition to an erected condition wherein the exterior side walls define an elongated rectangular carton with right angle corners;

(b) end closure flaps foldably attached to the end edges of said side walls;

(c) an internal product supporting and locating structure within the carton consisting of a substantially full length interior wall panel said wall panel having a length substantially equal to the length of said side walls connected between two opposed side walls of the carton to form two separate compartments that extend the full length of said carton;

(d) a first glue flap foldably attached along a first portion of said interior wall panel and adhered to the inside of one of said carton side walls to secure the carton side walls together;

(e) a second glue flap foldably attached along a second portion of said interior wall panel and adhered to the side wall of said carton opposite said first glue flap to retain said interior wall panel in position and to form a first compartment that is unobstructed for easy loading;

(f) an auxiliary glue tab cut from said first glue panel and adhered to the side wall of said carton next to said second glue flap; and, (g) an integral bridge member for one of said compartments, said bridge member being foldably attached to a first portion of said interior wall panel and arranged to extend between said interior wall panel and an adjacent side wall of the carton, said bridge member including a first glue panel that is adhered to said interior wall panel, a bridge panel connected to said first glue panel and a third glue flap adhered to an adjacent carton side wall to position said bridge panel between said interior wall panel and said adjacent carton side wall.

2. A reinforced end loaded, elongated compartmented carton formed from a single blank of paperboard or the like comprising:

(a) a plurality of elongated outer carton side walls foldably attached to one another at their elongated side edges along parallel fold lines;

(b) a glue panel foldably connected to an edge of one of said side walls and adhered to another of said side walls;

(c) a substantially full length interior wall panel foldably attached to said glue panel said wall panel having a length substantially equal to the length of said glue panel and arranged to extend substantially perpendicular between two opposed side walls to divide the carton into two elongated compartments that extend the full length of said carton;

(d) a pair of glue flaps foldably attached along a common score line to said interior wall panel, one of said pair of glue flaps being adhered to the side wall opposite the side wall to which the glue panel is adhered and the other of said pair of glue flaps being reversely folded and adhered to the inner surface of said interior wall;

(e) a bridge panel foldably attached to the other of said glue flaps and arranged to extend substantially perpendicular between the interior wall and an adjacent side wall; and, (f) a single glue flap foldably attached to said bridge panel and adhered to said adjacent side wall.

* * * * *